US006026898A

United States Patent [19]

Bland et al.

[11] Patent Number: 6,026,898

[45] Date of Patent: Feb. 22, 2000

[54] INTEGRAL TUBING HEAD AND ROTATOR

[75] Inventors: Linden H. Bland, Edmonton; David W. Campbell, Ardrossan, both of Canada

[73] Assignee: Campbell Industries Ltd., Alberta, Canada

[21] Appl. No.: 08/967,439

[22] Filed: Nov. 11, 1997

[30] Foreign Application Priority Data

Jul. 11, 1997 [CA] Canada ..... 2210239

[51] Int. Cl.[7] ..... G21B 33/04

[52] U.S. Cl. ..... 166/78.1

[58] Field of Search ..... 166/75.11, 75.14, 166/77.51, 78.1, 104

[56] References Cited

U.S. PATENT DOCUMENTS

| | | | |
|---|---|---|---|
| 1,650,102 | 11/1927 | Tschappat | 166/75.11 |
| 1,662,984 | 3/1928 | Scott et al. | 166/78.1 |
| 1,965,907 | 7/1934 | Pierce | 166/77.51 |
| 2,178,700 | 11/1939 | Penick et al. | 166/78.1 |
| 2,294,061 | 8/1942 | Williamson | 166/75.14 |
| 2,471,198 | 5/1949 | Cormany | 166/75.14 |
| 2,595,434 | 5/1952 | Williams | 166/75.14 |
| 2,599,039 | 6/1952 | Baker | 166/75.14 |
| 2,623,734 | 12/1952 | Sibble | 166/75.14 |
| 2,630,181 | 3/1953 | Solum | 166/75.14 |
| 2,693,238 | 11/1954 | Baker | 166/75.14 |
| 2,788,073 | 4/1957 | Brown | 166/78.1 |
| 2,788,074 | 4/1957 | Brown | 166/75.14 |
| 3,301,324 | 1/1967 | Smith | 166/75.14 |
| 3,494,638 | 2/1970 | Todd et al. | 166/77.51 |
| 4,601,343 | 7/1986 | Lindsey, Jr. et al. | 166/75.14 |
| 4,630,688 | 12/1986 | True et al. | 166/78.1 |
| 4,716,961 | 1/1988 | Makins, Jr. et al. | 166/75.14 |
| 4,993,276 | 2/1991 | Edwards | 166/75.14 |
| 5,139,090 | 8/1992 | Land | 166/77.51 |
| 5,327,975 | 7/1994 | Land | 166/75.14 |
| 5,383,519 | 1/1995 | Wright et al. | 166/75.51 |
| 5,427,178 | 6/1995 | Bland | 166/75.51 |
| 5,429,188 | 7/1995 | Cameron et al. | 166/75.11 |
| 5,431,230 | 7/1995 | Land et al. | 166/78.1 |
| 5,465,788 | 11/1995 | Wright | 166/75.11 |

FOREIGN PATENT DOCUMENTS

| | | |
|---|---|---|
| 2163946 | 10/1997 | Canada . |
| 0535277A1 | 4/1993 | European Pat. Off. . |

OTHER PUBLICATIONS

Materials from Dynamic Oil Tools Inc. for the "Dynamic Dizzy Dognut Tubing Rotator," undated (3 pages).

*Primary Examiner*—William Neuder
*Assistant Examiner*—John Kreck
*Attorney, Agent, or Firm*—Rodman & Rodman

[57] ABSTRACT

A tubing head is provided for accommodating a rotator. The rotator includes a drive gear and a swivel tubing hanger which engages an internal surface of the tubing head and comprises a driven gear for engaging the drive gear. The tubing head defines a gear housing for the drive gear so that the drive gear may releasably engage the driven gear. The internal surface, gear housing and drive and driven gears are configured such that when the drive gear is in the gear housing, the tubing hanger engages the internal surface and the drive and driven gears are engaged, the tubing hanger may be removed from the tubing head by pulling it through the upper end without first disengaging the drive and driven gears. An apparatus is also provided comprising the tubing head, the swivel tubing hanger and the drive gear.

33 Claims, 8 Drawing Sheets

INTEGRAL TUBING HEAD AND ROTATOR

FIELD OF INVENTION

The within invention relates to a tubing head designed to accommodate a tubing rotator therein such that the tubing head may be retrofit with the tubing rotator. Further, the within invention relates to an apparatus for attachment to a wellhead for suspending and rotating a tubing string within a wellbore, the apparatus comprising a tubing head and a tubing rotator combined to form a single, integral unit.

BACKGROUND ART

A typical wellhead is often comprised of a casing head or a casing bowl which engages or is otherwise mounted to a casing string contained within a wellbore of a well at the surface. A tubing head or tubing bowl is mounted upon the upper surface of the casing head and provides a support mechanism for a tubing hanger. The tubing hanger is connected to or engages the upper end of the tubing string which is contained within the wellbore. Thus, the tubing hanger and the tubing string connected thereto are supported at the surface of the well by the tubing head. Alternately, the wellhead may not include a casing head. In this case, the tubing head is mounted directly to the casing string at the surface of the well. A reciprocating rod or tube or a rotating rod or tube is then run through the tubing string for production of the well.

A typical wellhead may also further include a tubing rotator. Tubing rotators are used in the industry to suspend and rotate the tubing string within the wellbore. By rotating the tubing string, typical wear occurring within the internal surface of the tubing string by the reciprocating or rotating rod string is distributed over the entire internal surface. As a result, the tubing rotator may prolong the life of the tubing string. Further, the constant movement of the tubing string relative to the rod string may inhibit or reduce buildup of wax and other materials within the tubing string.

Conventional tubing heads are not typically able to be retrofitted to accommodate the necessary structure of a tubing rotator, including the drive system for causing the rotation of the tubing string. Thus, the tubing head may require replacement in the event the operator of the well chooses to commence the use of a rotator subsequent to the initial completion of the well and the wellhead. Further, when a conventional tubing rotator is used in combination with a conventional tubing head, the rotator is typically mounted on top of the tubing head. This arrangement may increase the overall height of the wellhead and may result in the instability of the wellhead by weakening its overall structure.

As well, in order to service the well, the tubing hanger and the connected tubing string must typically be removed from the well. However, any disturbance of the tubing string during servicing may lead to a blowout. To avoid this risk in a conventional well without a tubing rotator, the portion of the wellhead above the tubing head is typically removed and a blowout preventer is mounted to the tubing head. The tubing hanger with the attached tubing string are then removed through the blowout preventer.

Where the wellhead includes a tubing rotator, the structure of the rotator tends to interfere with the installation of the blowout preventer. Thus, in order to service the well, the rotator, or at least a portion of it, must typically be removed from the tubing head. Removal of all or a portion of the rotator may require or result in disturbance of the tubing string, which may lead to a blowout.

Further, when a rotator is in use in the wellhead, the tubing hanger is typically comprised of a swivel dognut assembly. The swivel dognut assembly is comprised of a rotatable mandrel, which is connected to and suspends the tubing string within the wellbore, and a drive system for rotating the mandrel which results in the rotation of the tubing string. The drive system is conventionally comprised of a system of gears which engages the mandrel either directly or indirectly to cause it to rotate. In order to remove these conventional rotators and tubing hangers for servicing of the well, the gear system must first be removed from the rotator such that the mandrel is no longer directly or indirectly engaged thereby. Where the gear system is not so removed, due to an error or oversight, the rotator and the wellhead may be seriously damaged resulting in the costly replacement of equipment, a loss of production during replacement of the equipment and a potential for the blowout of the well.

As well, in order to service the well, a pup joint or servicing tool is typically threaded into the upper end of the inner rotatable mandrel of the swivel tubing hanger. However, upon the removal of the drive system for servicing of the well, the inner mandrel is typically able to freely rotate within the outer supporting structure of the tubing hanger. As a result, connection of the servicing tool may be problematic due to the difficulties encountered in obtaining and ensuring a secure connection between the servicing tool and the inner mandrel of the tubing hanger. This problem is typically addressed by the insertion of a key between the inner mandrel and the outer supporting structure of the tubing hanger during servicing of the well in order to inhibit the rotation of the inner mandrel.

There is therefore a need in the industry for a tubing head capable of accommodating the functional structure or elements of a tubing rotator therein such that the tubing head may be retrofit and converted from its use as a conventional tubing head into its use as a combined tubing head and rotator. Further, there is a need for an apparatus which combines the functional elements of a tubing head and a tubing rotator in a single, integral unit.

As well, there is a need for such a tubing head and apparatus that are relatively compact and that will facilitate the servicing of the well. More particularly, there is a need for such a tubing head and apparatus that permit the removal of the tubing string from the well therethrough without first requiring the removal of all or a portion of the tubing head or apparatus, including the drive system of the tubing rotator. Further, there is a need for such a tubing head and apparatus which permits the removal of the tubing string through a service blowout preventer mounted thereon without first moving the tubing string connected to the tubing rotator. Finally, there is a need for such an apparatus that facilitates the connection of a servicing tool to the components of the tubing rotator during the servicing of the well.

DISCLOSURE OF INVENTION

The present invention relates to a tubing head capable of accommodating the functional structure or elements of a tubing rotator therein such that the tubing head may be retrofit and converted from its use as a conventional tubing head into its use as a combined tubing head and rotator. Further, the present invention relates to an apparatus which combines the functional elements of a tubing head and a tubing rotator in a single, integral unit.

As well, the present invention preferably relates to such a tubing head and apparatus that are relatively compact and that will facilitate the servicing of the well. In addition, the present invention relates to such a tubing head and apparatus which are configured such that the tubing string is removable from the well therethrough without first requiring the removal of all or a portion of the tubing head or apparatus, including the drive system of the tubing rotator. Further, the present invention preferably relates to such a tubing head and apparatus which are configured such that the tubing string is removable through a service blowout preventer mounted thereon without first moving the tubing string connected to the tubing rotator. Finally, the present invention preferably relates to such an apparatus which facilitates the connection of a servicing tool to the components of the tubing rotator of the apparatus during the servicing of the well.

In a first aspect of the invention, the invention relates to a tubing head for accommodating a tubing rotator therein, the tubing head being of the type having an upper end, a lower end for attachment to a wellhead and an internal bore extending between the upper and lower ends, wherein the tubing rotator comprises a drive gear and a swivel tubing hanger for rotatably suspending a tubing string contained within a wellbore, the tubing hanger comprising an external surface for engaging the internal bore of the tubing head such that the tubing hanger may be suspended thereby and a driven gear for engaging the drive gear, the improvement which comprises:

(a) the internal bore of the tubing head defining an internal surface for engaging the external surface of the tubing hanger such that the tubing hanger may be suspended by the tubing head; and (b) the tubing head defining a gear housing for containing the drive gear therein, wherein the gear housing communicates with the internal bore such that the drive gear may releasably engage the driven gear of the tubing hanger when the tubing hanger is suspended by the tubing head;

wherein the internal surface, the gear housing, the drive gear and the driven gear are configured such that when the drive gear is contained within the gear housing, the tubing hanger is located in the internal bore and the driven gear is engaging the drive gear, the tubing hanger is capable of being removed from the internal bore by pulling it through the upper end of the tubing head without first disengaging the drive gear from the driven gear.

In a second aspect of the invention, the invention relates to an apparatus for attachment to a wellhead for suspending and rotating a tubing string contained within a wellbore, the apparatus comprising:

(a) a tubing head having an upper end, a lower end for attachment to a wellhead and an internal bore extending between the upper and lower ends, wherein the internal bore of the tubing head defines an internal surface and wherein the tubing head further defines a gear housing which communicates with the internal bore;

(b) a swivel tubing hanger for locating within the internal bore and for connecting to the tubing string, the tubing hanger comprising a driven gear and an external surface for engaging the internal surface of the tubing head such that the tubing hanger may be suspended by the tubing head; and (c) a drive gear for containing within the gear housing and for releasably engaging the driven gear of the tubing hanger;

wherein the internal surface, the gear housing, the drive gear and the driven gear are configured such that when the drive gear is contained within the gear housing, the tubing hanger is located in the internal bore and the driven gear is engaging the drive gear, the tubing hanger is capable of being removed from the internal bore by pulling it through the upper end of the tubing head without first disengaging the drive gear from the driven gear.

In the first and second aspects, any configuration of the tubing head able to achieve the functions or purpose of the tubing head as described above may be used However, preferably, the internal bore of the tubing head defines a minimum diameter of the bore. Further, the gear housing is preferably configured such that when the drive gear is contained within the gear housing, it does not protrude into the internal bore within the minimum diameter. As well, the internal surface of the tubing head preferably defines a maximum diameter of the internal bore which is about equal to a maximum diameter of the tubing hanger. When a service blowout preventer is mounted on the upper end of the tubing head and the tubing hanger is located in the internal bore, the maximum diameter of the tubing hanger preferably permits the tubing hanger to be removed from the internal bore by pulling it through the blowout preventer in order to service the well.

Further, in the preferred embodiment, the drive gear and the driven gear engage each other between the minimum diameter and the maximum diameter of the internal bore. The drive gear and the driven gear may be comprised of any compatible gears suitable for performing their functions or purpose and which engage each other between the minimum and maximum diameters of the internal bore. However, preferably, the drive gear is comprised of a worm and the driven gear is comprised of a worm gear. Further, in the preferred embodiment, the worm and the worm gear are non-enveloping in order to facilitate the removal of the tubing hanger from the internal bore without first disengaging the worm from the worm gear.

The worm gear is comprised of a plurality of worm gear teeth and the worm is comprised of a plurality of worm teeth. These worm gear and worm teeth may have any shape or configuration permitting the removal of the tubing hanger from the internal bore without first disengaging the worm from the worm gear. In addition, the shape and configuration preferably facilitate the feeding of the worm gear onto the worm and the feeding of the tubing hanger into the internal bore of the tubing head. In the preferred embodiment, a lower end of each worm gear tooth is tapered inwardly towards a centre of the tooth in order to facilitate the feeding of the worm gear onto the worm. In addition, the lower end of each worm gear tooth is sloped downwardly from a top face to a bottom face of the tooth in order to facilitate the feeding of the tubing hanger into the internal bore of the tubing head. Finally, a crest of each worm tooth is tapered to facilitate the feeding of the worm gear onto the worm.

The tubing head is preferably further comprised of any means, structure, mechanism or device for inhibiting the longitudinal movement of the tubing hanger in a direction toward the upper end of the tubing head. Preferably, the upwards longitudinal movement of the tubing hanger is inhibited by the tubing head which is comprised at least one adjustable holddown screw for engagement with the tubing hanger such that when the holddown screw is adjusted for engagement with the tubing hanger, longitudinal movement of the tubing hanger in a direction toward the upper end of the tubing head is inhibited. In the preferred embodiment, the tubing head is comprised of at least two holddown screws located adjacent the upper end of the tubing head.

In addition, the tubing head is further preferably comprised of means for mounting the tubing head on the wellhead. Any means, mechanism, structure or device capable of and suitable for temporarily or permanently mounting or connecting the tubing head to the wellhead may be used. Preferably, the mounting means are capable of connecting the lower end of the tubing head on the wellhead. In addition, the mounting means may be suitable for mounting or connecting the lower end of the tubing head to any portion or component of the wellhead, but preferably, the mounting means are compatible with mounting the tubing head to a casing string or a casing head or an existing tubing head.

For instance, when the wellhead is comprised of a casing string, the mounting means may be comprised of a mounting portion of the internal bore of the tubing head adjacent the lower end, which mounting portion is adapted for connection to the casing string. When the wellhead is comprised of a casing head or an existing tubing head, the mounting means may be comprised of a lower surface on the lower end of the tubing head, which lower surface is adapted for connection to the casing head or the existing tubing head. Preferably, in this case, the lower surface of the tubing head is comprised of a mounting flange.

Finally, the tubing head is further preferably comprised of means for connecting the upper end of the tubing head to other wellhead equipment. Any means, mechanism, structure or device capable of and suitable for temporarily or permanently mounting or connecting the upper end of the tubing head to the other wellhead equipment may be used.

The tubing hanger may be comprised of any swivel tubing hanger compatible with its use within the tubing head and which permits the functioning of the apparatus as described herein. However, preferably, the tubing hanger is further comprised of: a supporting member comprising the external surface of the tubing hanger; and a supported member rotatably supported within the supporting member such that the longitudinal movement of the supported member relative to the supporting member in a direction toward the lower end of the tubing head is inhibited, the supported member having an upper end and a lower end for connecting to the tubing string and wherein the supported member is associated with the driven gear such that rotation of the driven gear causes the supported member to rotate within the supporting member.

The supported member may be associated with the driven gear in any manner or by any means, mechanism, structure or device which permits the functioning of the tubing hanger as described herein and which permits the drive gear to engage the driven gear. However, in the preferred embodiment, the driven gear is fixedly mounted about the supported member such that the driven gear extends from the supported member towards the gear housing of the tubing head for engagement with the drive gear.

The tubing hanger further preferably comprises means for inhibiting the longitudinal movement of the supported member relative to the supporting member in a direction toward the upper end of the tubing head. Any means, structure, mechanism or device for inhibiting the upwards longitudinal movement of the supported member relative to the supporting member may be used. However, preferably, the inhibiting means is comprised of the abutment of the driven gear and the supporting member.

Any means, mechanism, device or structure capable of supporting the supported member in the required manner which is compatible with the function of a the tubing hanger, may be used. However, preferably, the supported member is rotatably supported within the supporting member by at least one bearing located between the supported member and the supporting member such that the bearing is seated on the supporting member and the supported member is rotatably supported upon the bearing. Any bearing suitable for, and compatible with, this intended purpose or function may be used. For instance, the bearing may be comprised of a thrust bearing, a radial bearing, a tapered roller bearing or a combination thereof. In the preferred embodiment, the bearing is comprised of a thrust bearing in combination with a bushing sleeve.

BRIEF DESCRIPTION OF DRAWINGS

Embodiments of the invention will now be described with reference to the accompanying drawings, in which.

BEST MODE OF CARRYING OUT INVENTION

Figure 1:
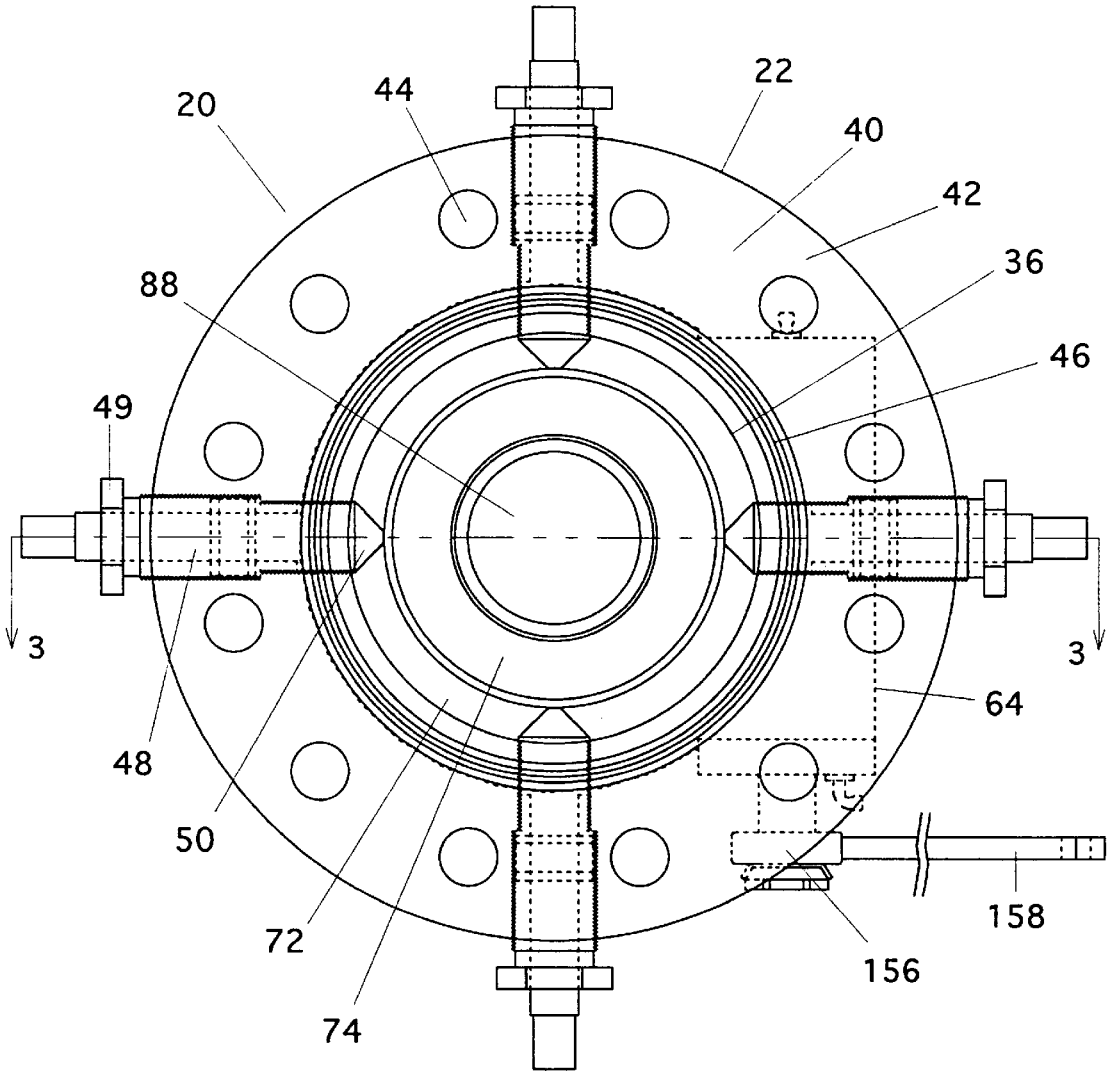
FIG. 1 is a top view of a preferred embodiment of the apparatus of the within invention.
Figure 2:
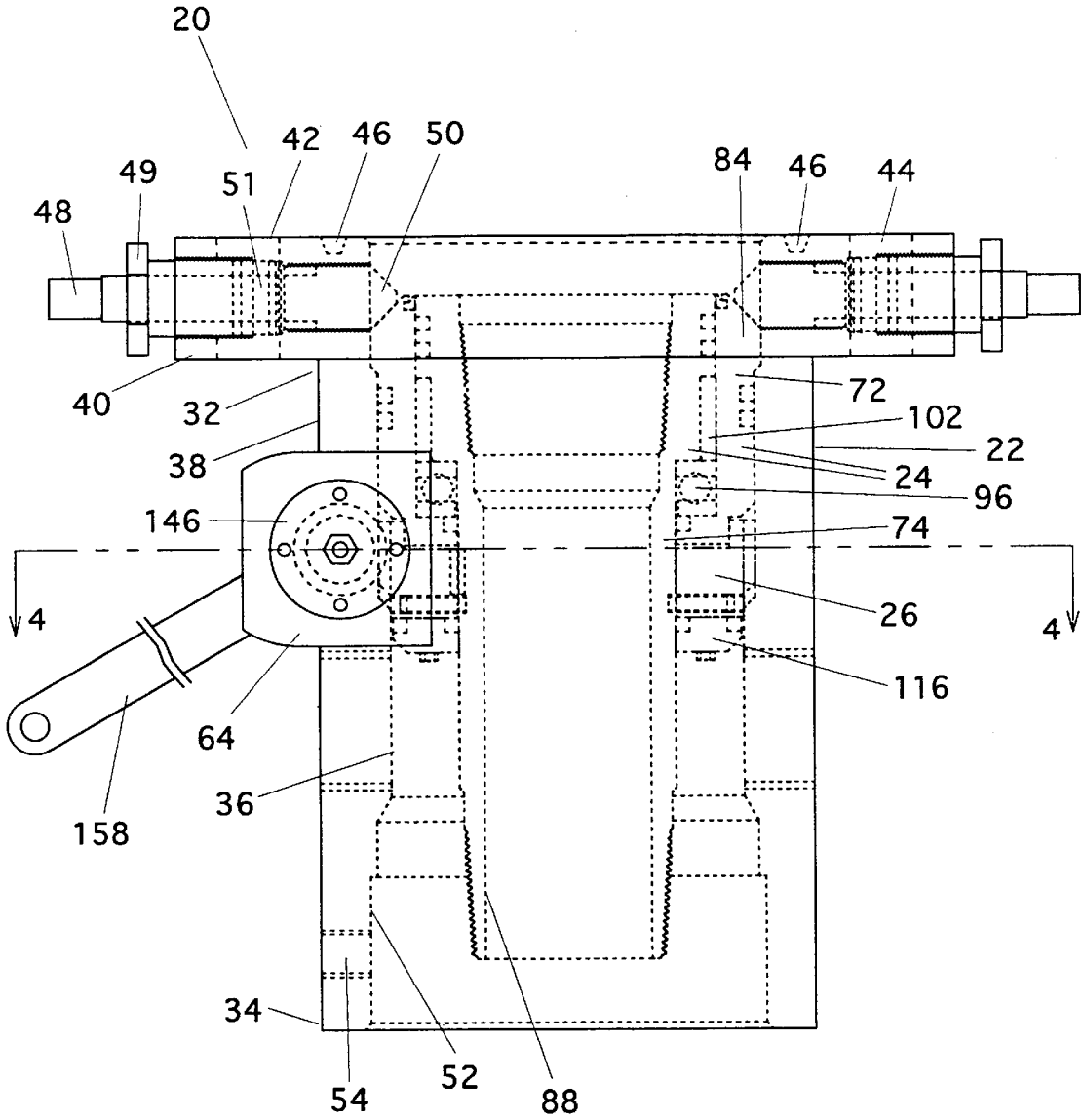
FIG. 2 is a side view of the preferred embodiment of the apparatus shown in FIG. 1.
Figure 3:
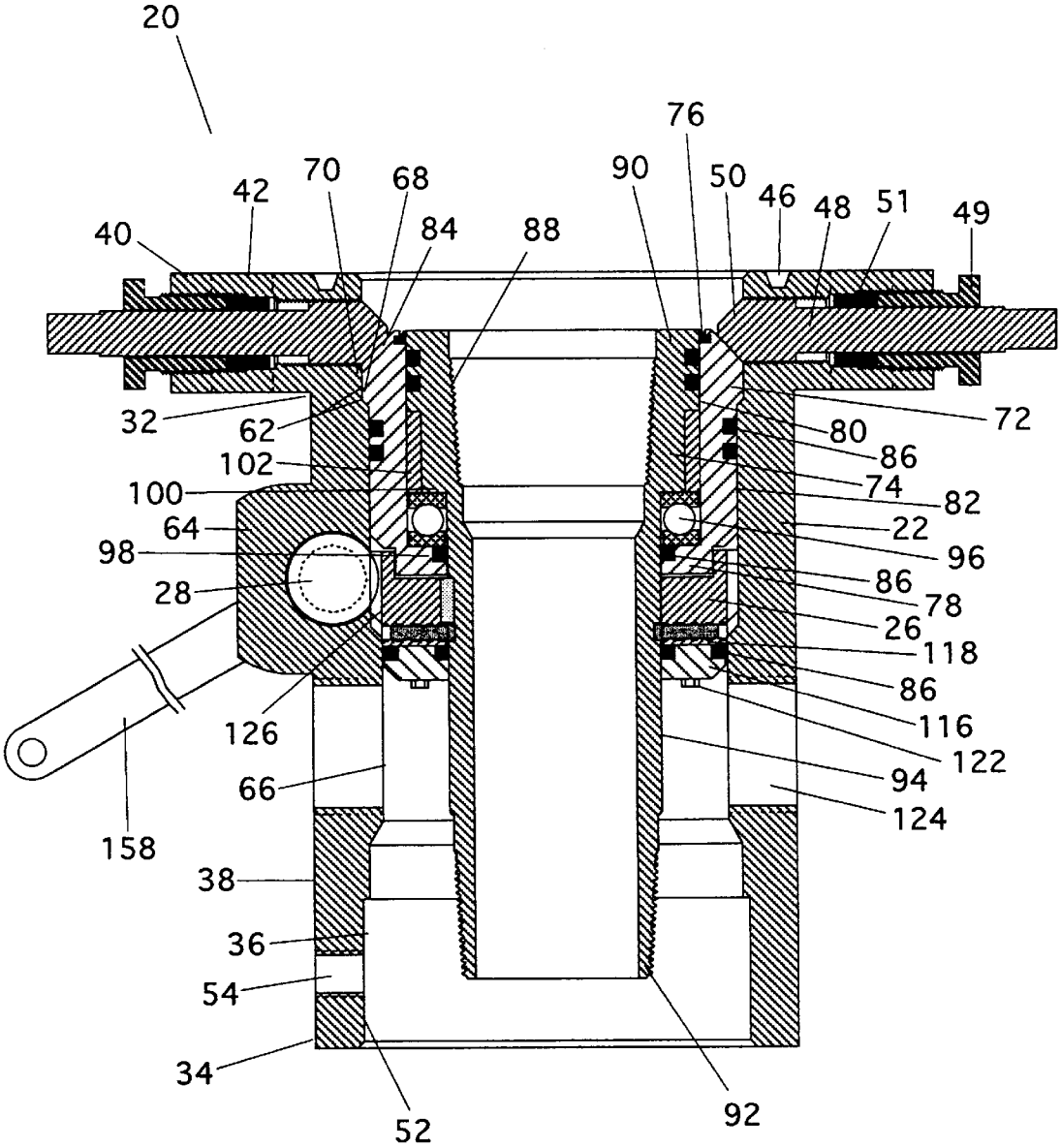
FIG. 3 is a longitudinal sectional view of the preferred embodiment of the apparatus taken along line 3—3 of FIG. 1.

Referring to FIGS. 1–3, the within invention is directed at an apparatus (20) for attachment to a wellhead for suspending and rotating a tubing string contained within a wellbore. More particularly, the apparatus (20) combines the functions of a tubing head (22) and a tubing rotator in a single, integral unit. Further, referring to FIG. 9, the within invention is further directed at an improved tubing head (22) for attachment to the wellhead, which is able to accommodate the functional features or elements of a tubing rotator.

A typical wellhead is comprised of a plurality of components mounted at the ground surface above the wellbore. A rod or rod string is run through the wellhead and into the wellbore through a continuous fluid passage or pathway which extends through each of the components of the wellhead. The well may be produced by a reciprocating rod or tube, reciprocated by a pump jack or walking beam at the surface, or by a rotating rod or tube, driven by a rotary pump drive at the surface.

Further, a typical wellhead is comprised of a casing head or a casing bowl which engages or is otherwise mounted to a casing string contained within the wellbore of the well at the surface. A tubing head or tubing bowl may be mounted upon the upper surface of the casing head to provide a support mechanism for a tubing hanger. The tubing hanger is connected to or engages the upper end of a tubing string which is contained within the wellbore. Alternately, the wellhead may not include a casing head. In this case, the tubing head is typically mounted directly to the casing string at the surface of the well.

The apparatus (20) is comprised of a tubing head (22) and the functional components of a tubing rotator. The functional components of the tubing rotator are comprised of a swivel tubing hanger (24) and a drive gear (28) housed within the tubing head (22). The tubing hanger (24) is for connecting to the tubing string such that the tubing string is rotatably suspended thereby. Further, the tubing hanger (24) includes a driven gear (26) which is compatible with the drive gear (28) and is releasably engagable therewith. Thus, the driven gear (26) and the drive gear (28) comprise the drive system of the apparatus (20) which causes the tubing string connected to the tubing hanger (24) to be rotated within the wellbore.

Figure 9:
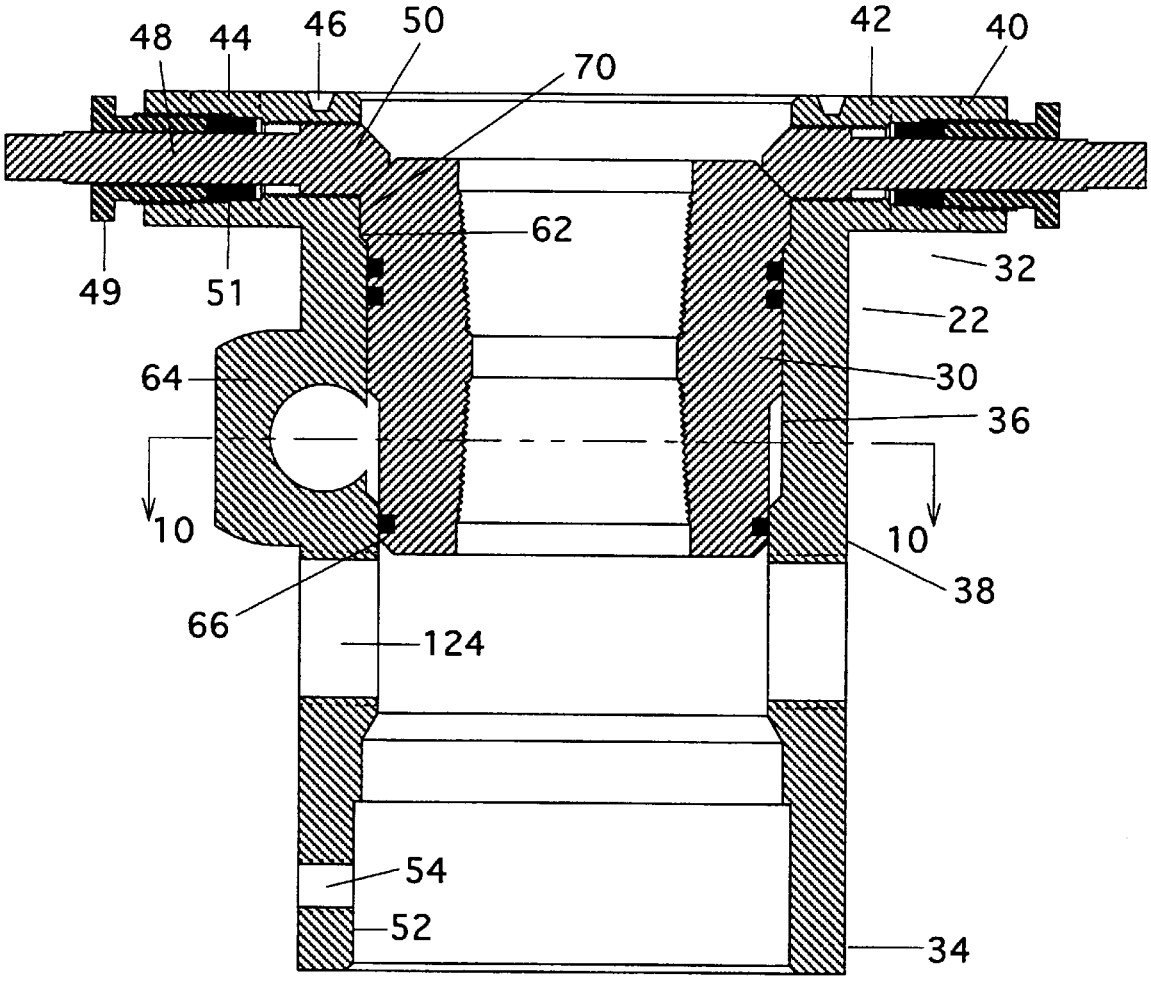
FIG. 9 is a longitudinal sectional view of a preferred embodiment of the tubing head of the within invention, taken along a line similar to that of FIG. 3 for the preferred embodiment of the apparatus, shown in use with a non-swivel tubing hanger.

The tubing head (22) may be used in isolation where the tubing rotator feature of the apparatus (20) is not required or desired by the operator of the well. In this case, as shown in FIG. 9, the tubing head (22) may be used with any conventional non-swivel tubing hanger (30) compatible with the tubing head such that the tubing hanger (30), and the connected tubing string, may be suspended within or by the tubing head (22). In the event that the operator of the well subsequently desires to include a tubing rotator within the wellhead structure, the tubing head (22) may be easily retrofit to operate as a tubing rotator by the addition of the functional components of the tubing rotator, being the swivel tubing hanger (24) and the drive gear (26) of the within invention. The tubing head is easily retrofit in this manner because it is specifically designed to accommodate these components in the event they are desired.

Figure 4:
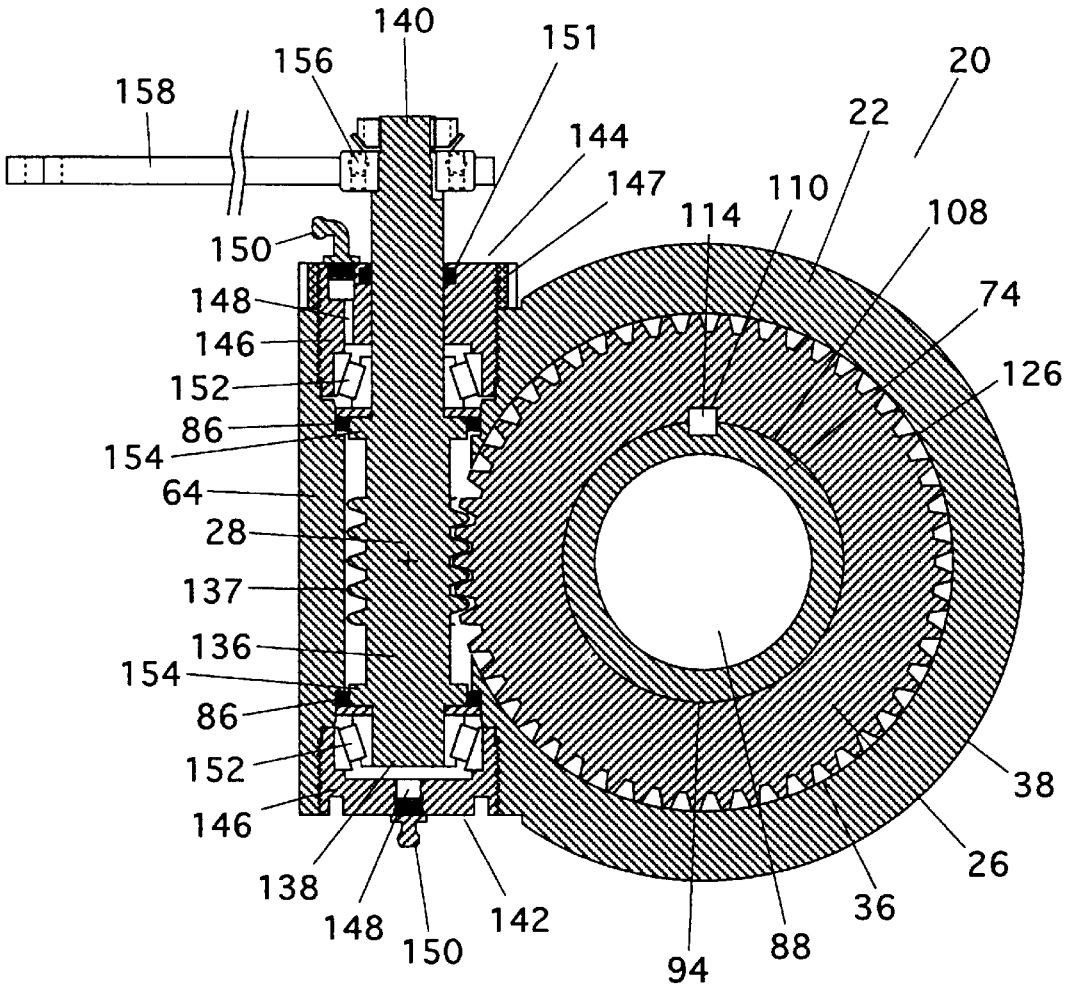
FIG. 4 is a cross sectional view of the preferred embodiment of the apparatus taken along line 4—4 of FIG. 2, showing in detail a drive system comprising a worm and a worm gear.
Figure 7:
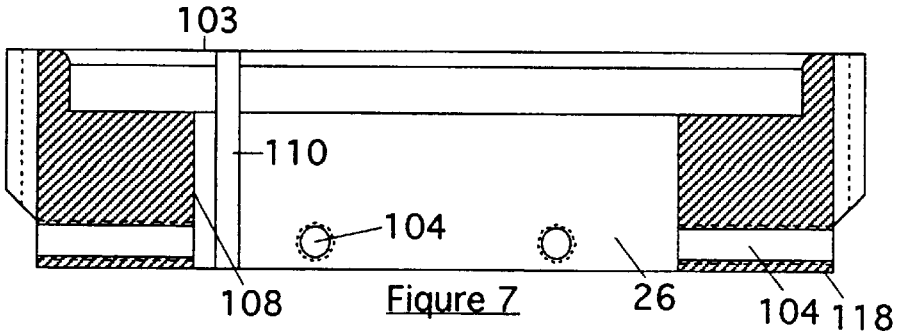
FIG. 7 is a longitudinal sectional view of the worm gear taken along line 7—7 of FIG. 5.
Figure 6:
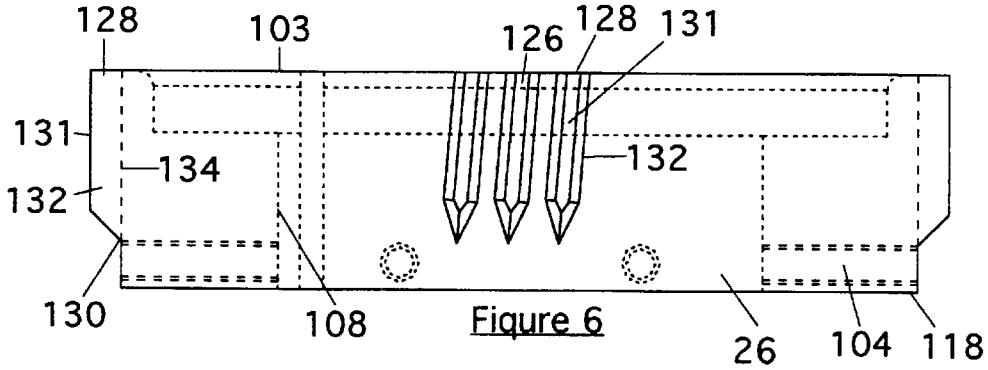
FIG. 6 is a side view of the worm gear shown in FIG. 5.
Figure 10:
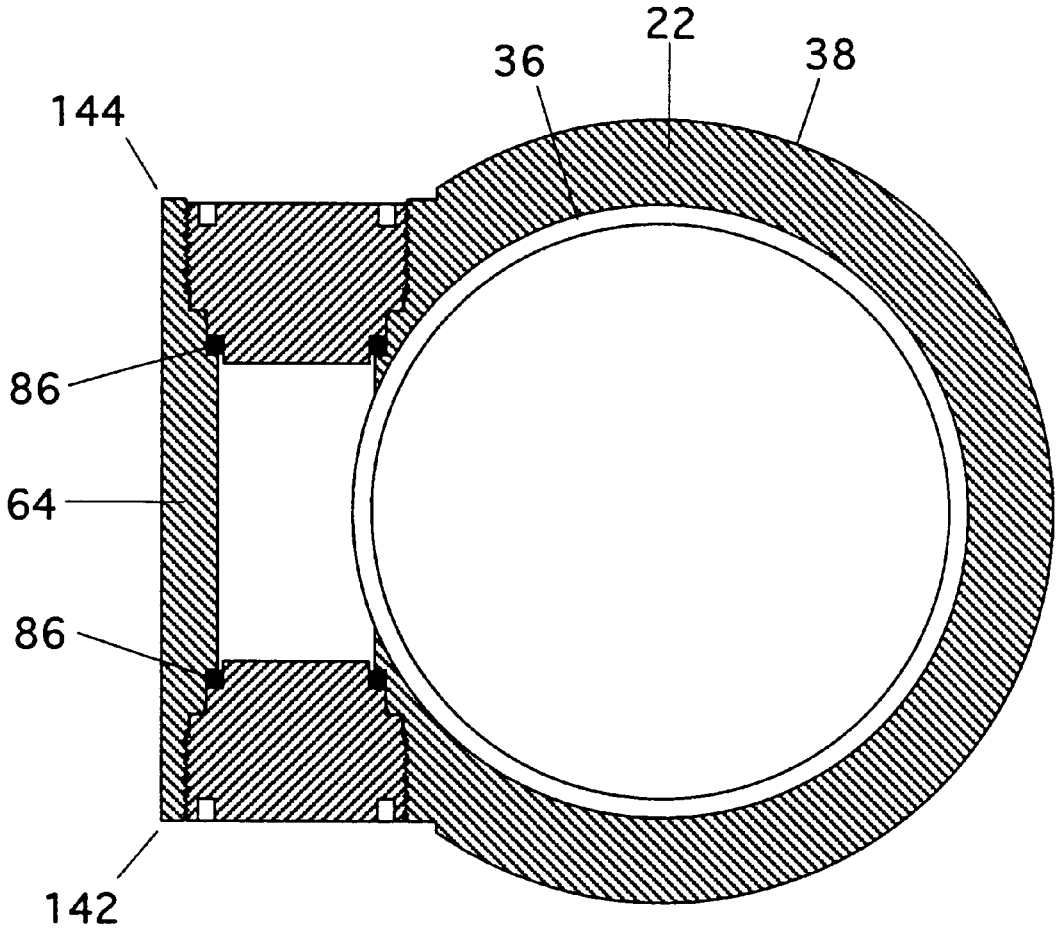
FIG. 10 is a cross sectional view of the preferred embodiment of the tubing head taken along line 10—10 of FIG. 9.

Referring to FIGS. 1–4 and 8–10, the tubing head (22) has an upper end (32), a lower end (34), an internal bore (36) extending between the upper and lower ends (32, 34) and an outer wall (38). The tubing head (22) may be of any shape or configuration suitable for its intended function purpose as described herein. However, the tubing head (22) is preferably tubular on cross section, as shown in FIGS. 4 and 10, such that the circumference of the tubing head (22) defines the outer wall (38).

The upper end (32) of the tubing head (22) is preferably connectable to other components of the wellhead or other wellhead equipment by any fastening or connecting means, mechanism, structure or device suitable for temporarily fastening or connecting the tubing head (22) to such other wellhead equipment. Thus, further wellhead equipment may be mounted upon the tubing head (22) or the apparatus (20). Specifically, the tubing head (22) is preferably connectable directly or indirectly to a service blowout preventer so that a service blowout preventer may be mounted to the tubing head (22) during servicing of the well without first requiring the moving of the tubing string and without first requiring the removal of all or a portion of the tubing head (22) or the apparatus (20). Although the connection is preferably a temporary connection, permitting the removal of the other equipment, where required or desired the connecting or fastening means may permit or cause a permanent connection between the tubing head (22) and the other equipment.

In the preferred embodiment, the means for connecting the upper end (32) of the tubing head (22) to other wellhead equipment is comprised of a tubing head flange (40) located at the upper end (32) of the tubing head (22). As a result, the tubing head flange (40) forms the uppermost surface of the tubing head (22) and the uppermost surface of the apparatus (20). Further, in the preferred embodiment, the tubing head flange (40) is integral with the remainder or balance of the tubing head (22), and is thus continuous with the outer wall (38). Preferably, the tubing head (22) is cast, machined or otherwise formed such that the tubing head flange (40) is incorporated into or comprises the tubing head (22). However, alternately, the tubing head flange (40) may comprise a separate or distinct portion of the tubing head (22), which is connected to the upper end (32) of the tubing head (22) by any fastening or connecting means, device, apparatus or mechanism suitable for fastening or connecting the adjacent surfaces of the tubing head flange (40) and the tubing head (22). In this instance, the connection is preferably permanent, however, the tubing head flange (40) may be removably attached or connected to the upper end (32) of the tubing head (22) where preferred or otherwise desirable to permit versatility or flexibility with respect to the specific wellhead equipment which may be mounted upon the tubing head flange (40).

As shown in FIGS. 1–3, 8 and 9, the tubing head flange (40) is preferably comprised of an upper surface (42) on the upper end (32) of the tubing head (22), which upper surface (42) is adapted for connection to the other wellhead equipment. Any manner of adapting, or any structure, device or mechanism for adapting, the upper surface (42) for connection to the other wellhead equipment may be used. However, in the preferred embodiment, referring to FIG. 1, the tubing head flange (40) is comprised of the upper surface (42) defining at least two apertures (44), and preferably a plurality of apertures (44), spaced circumferentially about the internal bore (36) of the tubing head (22). The apertures (44) are for receiving fasteners, such as bolts, screws or the like, therein such that the other wellhead equipment may be fastened to the tubing head flange (40). Thus, the arrangement or configuration of the apertures (44) must be compatible with the adjacent wellhead equipment to be mounted upon the tubing head (22), and in particular, must be compatible with a flange or lowermost surface of such equipment. Further, the upper surface (42) of the tubing head flange (42) preferably defines an annular groove (46) about the circumference of the internal bore (36), for receiving an O-ring or other seal, for sealing between the adjacent surfaces of the tubing head flange (40) and the other wellhead equipment.

Preferably, the tubing head (22) is further comprised of any suitable means, structure, device or mechanism capable of inhibiting the upward longitudinal movement of the tubing hanger (24) relative to the tubing head (22), or movement in a direction towards the upper end (32) of the tubing head (22), when it is contained within the tubing head (22). In the preferred embodiment, referring to FIGS. 1–3, 8 and 9, the tubing head (22) includes at least one, and preferably two or more, adjustable holddown screws (48), located adjacent the upper end (32) of the tubing head (22) for inhibiting the relative movement of the tubing hanger (24) as discussed above. In particular, the holddown screws (48) engage the tubing hanger (24) contained within the internal bore (36) of the tubing head (22).

As described further below, each holddown screw (48) is adjustable such that when the holddown screw (48) is adjusted for engagement with the tubing hanger (24), longitudinal movement of the tubing hanger (24) supported within the internal bore (36), relative to the tubing head (22) in the direction of the upper end (32) of the tubing head (22), is inhibited. The holddown screws (48) are preferably located at or adjacent to the upper end (32) of the tubing head (22). However, any other location compatible with and suitable for the performance of their function or purpose as described herein may be used. In any event, each holddown screw (48) extends to the internal bore (36) of the tubing head (22) for engagement with the tubing hanger (24).

In the preferred embodiment, each holddown screw (48) extends through the tubing head flange (40) through a bore from its outer surface to the internal bore (36) of the tubing head (22). Further, in the preferred embodiment, the tubing head flange (40) includes four holddown screws (48) spaced about equidistantly apart. However, any number of holddown screws (48) may be located in the tubing head flange (40), having either equidistant or non-equidistant spacing therebetween. Further, the holddown screws (48) may be either symmetrically or non-symmetrically placed about the tubing head flange (40).

Each holddown screw (48) extends through a packing nut (49), which is held in place within the bore of the tubing head flange (40) by an outer threaded surface of the packing nut (49) compatible with an inner threaded surface of the bore of the tubing head flange (40). A nose (50) of each holddown screw (48) is similarly threaded on its outer surface in order that it is held in place within the bore of the tubing head flange (40) by the compatible inner threaded surface of the bore of the tubing head flange (40). Packing (51) is located between the inner end of the packing nut (49) and the nose (50) of the holddown screw (48).

The nose (50) of the holddown screw (48) is engagable with an outer surface of the tubing hanger (24) when the tubing hanger (24) is suspended within the tubing head (22). As described further below, the outer surface of the tubing hanger (24) includes a compatible engagement surface for receiving the nose (50) of each holddown screw (48). The holddown screws (48) are moveable within the bore of the tubing head flange (40) such that the holddown screws (48) are adjustable in order that the nose (50) may be moved into and out of engagement with the engagement surface as desired for operation or servicing of the wellhead. When the holddown screws (48) are loosened or moved away from the engagement surface, the tubing hanger (24) may be removed from the tubing head (22). Conversely, when the holddown screws (48) are tightened and moved into engagement with the engagement surface, longitudinal movement of the tubing hanger (24) relative to the tubing head (22) in the direction toward the upper end (32) is inhibited.

Similarly, the lower end (34) of the tubing head (22) is preferably connectable to the casing string, the casing head, an existing tubing head or any other suitable components of the wellhead, or wellhead equipment. Thus, the tubing head (22) is further comprised of means for mounting the tubing head (22) on the wellhead. Any means, structure, device or mechanism suitable for mounting the tubing head (22) to the particular wellhead structure may be used as long as it is compatible with the function and purpose of the tubing head (22) and the apparatus (20). Further, the mounting means may provide for either a temporary or a permanent connection between the tubing head (22) and the wellhead structure to which it is attached. In the preferred embodiment, the mounting means mount or connect the lower end (34) of the tubing head (22) to the wellhead.

In the preferred embodiment, as shown in FIG. 3, the lower end (34) of the tubing head (22) is adapted to be connectable to, or capable of being mounted upon, the casing string. Any manner, mechanism, structure or device for mounting the lower end (34) to the casing string which is compatible with the function and purpose of the tubing head (22) and the apparatus (20) may be used. However, preferably, the mounting means is comprised of the internal bore (36) of the tubing head (22) defining a mounting portion (52) adjacent to the lower end (34). The mounting portion (52) is adapted for connection to the casing string. In the preferred embodiment, the mounting portion (52) is sized and shaped to be compatible with the casing string so that the upper end or free end of the casing string may snugly or closely fit within the mounting portion (52) of the internal bore (36) of the tubing head (22).

Thus, to mount the tubing head (22), the mounting portion (52) is positioned or fitted about the casing string such that the bore of the casing string is continuous with the internal bore (36) of the tubing head (22). The tubing head (22) may then be temporarily or permanently fastened to the casing string by any suitable process, method, device, structure, mechanism or means for fastening the adjacent surfaces. However, preferably, the mounting portion (52) of the internal bore (36) is welded to the casing string. For this reason, the preferred embodiment of the tubing head (22), as shown in FIG. 3, includes a weld grease test port (54) adjacent the lower end (34) which extends from the outer wall (38) to the internal bore (36). The weld grease test port (54) is used to test the effectiveness of the weld.

Figure 8:
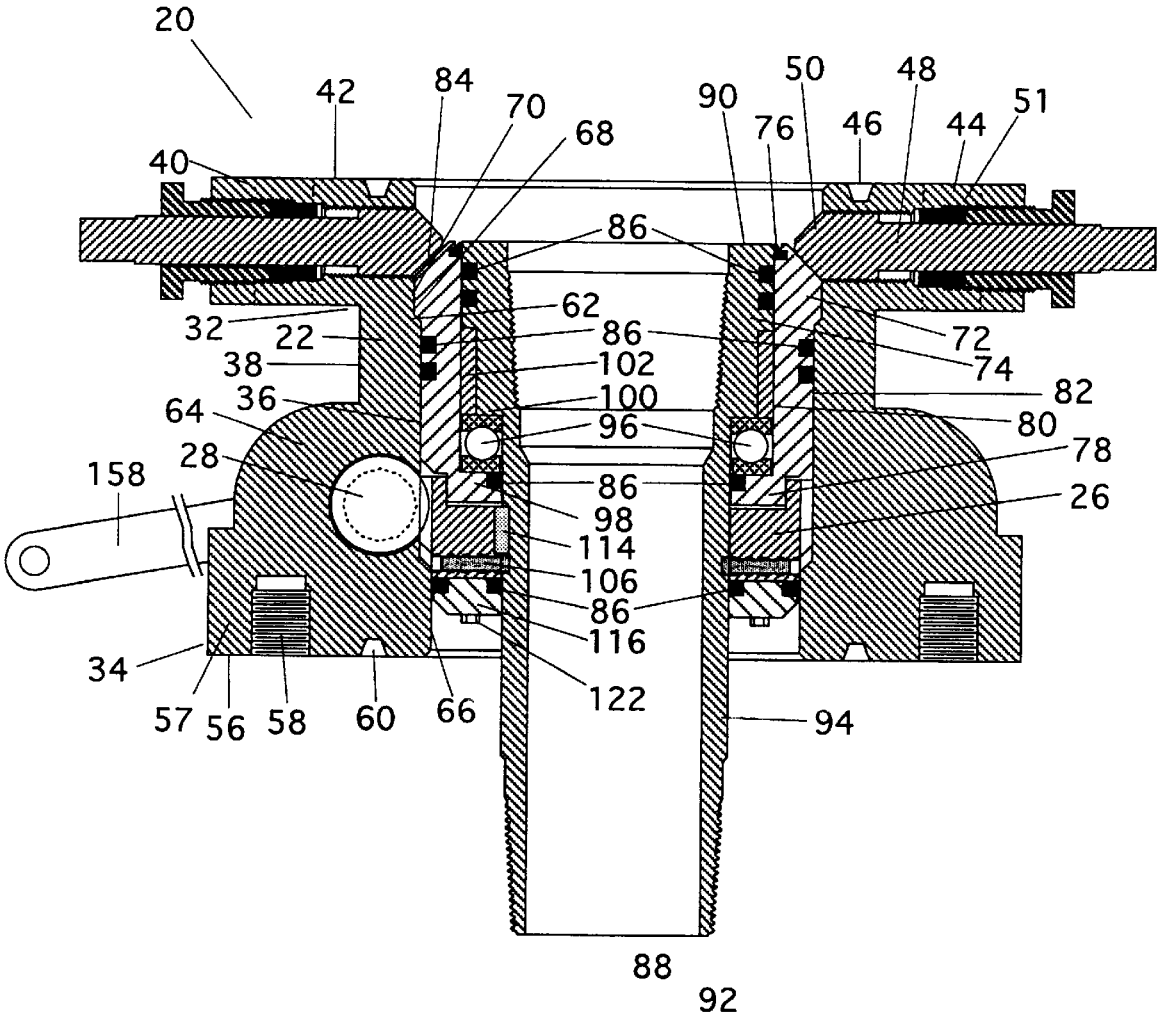
FIG. 8 is a longitudinal sectional view of an alternate embodiment of the apparatus, taken along a line similar to that of FIG. 3 for the preferred embodiment.

Referring to FIG. 8, alternately, the lower end (34) of the tubing head (22) may be adapted to be connectable to, or capable of being mounted upon, a casing bowl or casing head or an existing tubing head already present on the wellhead. In particular, conventional casing heads and conventional tubing heads are comprised of a flange, and the lower end (34) is connectable to the casing head or tubing head flange. Any manner, means, mechanism, structure or device for mounting or fastening the lower end (34) to the casing head or tubing head flange, which is compatible with the function and purpose of the tubing head (22) and the apparatus (20), may be used. Again, the mounting means may provide for either a temporary or a permanent connection as desired by the operator of the well.

In the preferred alternate embodiment, as shown in FIG. 8, the mounting means is comprised of a lower surface (56) on the lower end (34) of the tubing head (22), which lower surface (56) is adapted for connection to the casing head or existing tubing head, and preferably, the casing head or tubing head flange. Any manner of adapting, or any structure, means, device or mechanism for adapting, the lower surface (56) for connection to the casing head or tubing head flange may be used. However, in the preferred alternate embodiment, the lower surface (56) comprises a mounting flange (57) which defines at least two apertures (58), and preferably a plurality of apertures (58), circumferentially spaced about the mounting flange (57) at the lower surface (56). The apertures (58) are for receiving fasteners, such as bolts, screws or the like, therein. The apertures (58) are arranged or configured on the lower surface (56) to be compatible with the casing head or tubing head flange.

In the preferred alternate embodiment, to mount the tubing head (22), the mounting flange (57) is positioned on the casing head flange or the existing tubing head flange such that the apertures (58) in the lower surface (56) are aligned with the apertures in the casing head or tubing head flange. As a result, the bore of the casing head or the existing tubing head is aligned with the internal bore (36) of the tubing head (22). The fastener, being a stud bolt, is then screwed into the apertures (58) in the lower surface (56). When mounted, the fasteners extend from the apertures (58)

in the lower surface (56), through compatible apertures defined by the casing head or tubing head flange. A nut is then screwed onto the end of the fastener to secure the mounting flange (57), and thus the tubing head (22, upon the casing head or existing tubing head.

Finally, referring to FIG. 8 of the alternate embodiment, the lower surface (56) of the tubing head (22) preferably defines an annular groove (60) about the circumference of the lower surface (56), for receiving an O-ring or other seal, for sealing between the adjacent surfaces of the mounting flange (57) and the casing head or tubing head flange.

In addition, the internal bore (36) of the tubing head (22) defines an internal surface (62) for engagement with the tubing hanger (24) such that the tubing hanger (24) is suspended by the internal surface (62) within the internal bore (36). As well, the tubing head (22) further defines a gear housing (64) which communicates with the internal bore (36) and which is capable of accommodating and containing the drive gear (28) therein. As described in further detail below, the internal surface (62) defined by the internal bore (36), the gear housing (64), the drive gear (28) and the driven gear (26) are all configured such that when the drive gear (28) is contained within the gear housing (64), the tubing hanger (24) is located in the internal bore (36) and the driven gear (26) is engaging the drive gear (28), the tubing hanger (24) is capable of being removed from the internal bore (36) by pulling it through the upper end (32) of the tubing head (22) without first disengaging the drive gear (28) from the driven gear (26).

In other words, once the holddown screws (48) are released from engagement with the tubing hanger (24), the tubing hanger (24) may be lifted longitudinally upwards through the upper end (32) without requiring the removal or adjustment of any of the other components of the tubing head (22) or the apparatus (20). In particular, the removal of the tubing hanger (24) does not require the removal or adjustment or repositioning of any of the elements comprising the drive system, being the drive gear (28) and the driven gear (26). The same considerations apply to the placement of the tubing hanger (24) into the tubing head (22). As stated, this result is achieved by the specific configuration of the internal bore (36), including the internal surface (62), and the gear housing (64) in the within invention. In addition, the tubing hanger (24) and the drive system are compatible with the achievement of this function or purpose.

Further, in the preferred embodiment, the tubing head (22) and the compatible tubing hanger (24) are configured such that when a service blowout preventer is mounted on the upper end (32) of the tubing head (22) and the tubing hanger (24) is located in the internal bore (36), the tubing hanger (24) may be removed from the internal bore (36) by pulling it through the blowout preventer in order to service the well. As the blowout preventer may be mounted to the upper end (32) without requiring the removal of any of the components of the tubing head (22) or the apparatus (20), including the holddown screws (48), the position of the tubing string connected to the tubing hanger (24) is maintained in the wellbore. Thus, the likelihood of a blowout during the mounting process is minimized. Once the blowout preventer is mounted, the holddown screws (48) may be released and the tubing hanger (24), along with the connected tubing string, may be safely removed through the blowout preventer.

In particular, in the preferred embodiment, the internal bore (36) has a minimum and a maximum diameter. A portion of the internal bore (36) defines a minimum diameter (66) of the internal bore (36). In the preferred embodiment, the gear housing (64) is configured such that when the drive gear (28) is housed or contain within the gear housing (64), the drive gear (28) does not extend beyond the minimum diameter (66). In other words, the drive gear (28) does not protrude into the internal bore (36) within the minimum diameter (66) of the internal bore (36). The minimum diameter (66) of the internal bore (36) is determined by the specifications set by the American Petroleum Institute for any particular size of the tubing head (22) or the apparatus (20), and in particular by API Specification 6A (SPEC 6A) entitled "Specification for Wellhead and Christmas Tree Equipment". For instance, the minimum diameter (66) for the internal bore (36) for a 7¹⁄₁₆ inches diameter tubing head (22) is specified as 6.45 inches. Thus, the drive gear (28) does not encroach into the 6.45 inches diameter boundary.

As stated, the internal surface (62) defined by the bore (36) engages the tubing hanger (24) such that the tubing hanger (24) is suspended thereby. Any configuration of the engaged surfaces of the tubing head (22) and the tubing hanger (24), and any manner of engagement, may be used which permits the tubing hanger (24) to be suspended within the internal bore (36) by the tubing head (22). More particularly, the internal surface (62) of the internal bore (36) and the corresponding external surface (68) of the tubing hanger (24), described further below, are preferably shaped to be compatible in order to facilitate the seating of the external surface (68) of the tubing hanger (24) on the internal surface (62) such that the external surface (68) is supported thereby. The specific shape of the seating arrangement between the internal and external surfaces (62, 68) may vary from the internal surface (62) having a gradual angled slope through its length to the internal surface (62) having a vertical portion and a protruding horizontal or sloped shoulder portion. As shown in FIG. 3, in the preferred embodiment, the internal surface (62) which engages the tubing hanger (24) is comprised of a shoulder for seating and supporting the tubing hanger (24) thereon.

A portion of the internal bore (36) of the tubing head (22) also defines a maximum diameter (70) of the internal bore (36). In particular, in the preferred embodiment, the internal surface (62) defines the maximum diameter (70) of the internal bore (36). Further, the maximum diameter (70) of the internal bore (36) is preferably only slightly greater than the maximum diameter of the tubing hanger (24) so that a close fit and sealing engagement may be achieved therebetween. In other words, the maximum diameter (70) of the internal bore (36) is about equal to the maximum diameter of the tubing hanger (24).

The maximum diameter of the tubing hanger (24) is determined by the specifications set by the American Petroleum Institute for any particular size of the tubing hanger (24), and in particular by API Specification 6A (SPEC 6A) entitled "Specification for Wellhead and Christmas Tree Equipment". In particular, the maximum diameter (70) is determined by the maximum permissible diameter of the tubing hanger (24) which permits or allows that tubing hanger (24) to be run or pulled through a service blowout preventer. For instance, the maximum permissible diameter of the tubing hanger (24), for a 7¹⁄₁₆ inches diameter tubing head (22), which permits it to be pulled thorough a blowout preventer is 7.010 inches. Thus, the maximum diameter (70) of the internal bore (36) is slightly greater than, or about, 7.010 inches.

The difference between the minimum diameter (66) and the maximum diameter (70) provides a space or area which must accommodate the internal surface (62), comprising the shoulder in the preferred embodiment. In addition, the space or area between the minimum and maximum diameters (66, 70) must also accommodate a meshing between the drive gear (28) and the driven gear (26). Specifically, the drive gear (28) and the driven gear (26) engage each other between the minimum diameter (66) and the maximum diameter (70). In the preferred embodiment, utilizing a 7 1/16 inches diameter tubing head (22), the difference between the minimum and maximum diameters (66, 70) provides a space of 0.56 inches. The relative use of this space for the accommodation of the internal surface (62) and the meshing of the gears may be varied as required or desired. However, the relative use of this space must provide a sufficient internal surface (62) to permit the internal surface (62) to effectively engage the tubing hanger (24) such that it may be suspended within the internal bore (36) by the internal surface (62). In addition, the relative use of this space must provide or allow for a sufficient meshing between the drive gear (28) and the driven gear (26) such that the drive gear (28) may effectively engage the driven gear (26). In the preferred embodiment, the internal surface (62), and in particular the shoulder thereof, utilizes 0.13 inches of the total 0.56 inches diameter difference and the meshing of the gears, and in particular the protrusion of the drive gear (28) into the internal bore (36) utilizes 0.43 inches of the total 0.56 inches diameter difference.

Specific dimensions for tubing heads (22) of varying sizes, such as a 9 or 11 inches diameter tubing head, may be designed in the same manner and using the same principles as described above for the 7 1/16 inches diameter tubing head (22).

As stated, the apparatus (20) is further comprised of the swivel tubing hanger (24) for locating within the internal bore (36) of the tubing head (22) and for connecting to the tubing string. Any swivel tubing hanger (24) compatible with its use within the tubing head (22) and which permits the functioning of the apparatus (20) as described herein may be used. Preferably, the tubing hanger (24) is comprised of the driven gear (26) and the external surface (68) for engaging the internal surface (62) of the tubing head (22) such that the tubing hanger (24) may be suspended by the tubing head (22). In the preferred embodiment of the apparatus (20), the tubing hanger (24) is further comprised of a supporting member (72) and a supported member (74) rotatably supported within the supporting member (72).

supporting member (72) preferably comprises the external surface (68). Thus, the internal surface (62) of the tubing head (22) engages the external surface (68) of the supporting member (72). The supporting member (72) may be comprised of any members, elements, structure, device, apparatus or mechanism suitable for rotatably supporting the supported member (74) such that the tubing string connected to the supported member (74) may be rotatably supported within the wellbore. Further, the external surface (68) of the supporting member (72) may engage the internal surface (62) in any suitable manner permitting the supporting member (72) to be supported thereby and to perform its intended function. As well, the supporting member (72) may rotatably support the supported member (74) in any manner or by any means or mechanism suitable for performing this intended function.

In the preferred embodiment, the supporting member (72) is tubular to rotatably support the supported member (74) therein and includes an upper end (76), a lower end (78), an inside surface (80) and on outside surface (82). The outside surface (82) of the supporting member (72) is comprised of the external surface (68). In the preferred embodiment, the external surface (68) defines the maximum diameter of the tubing hanger (24), which is about equal to the maximum diameter (70) of the internal bore (36).

Although the location of the external surface (68) may vary, the external surface (68) is preferably positioned at, adjacent or in proximity to the upper end (76) of the supporting member (72). Thus, when the supporting member (72) is contained within the tubing head (22), the upper end (76) of the supporting member (72) is located within the internal bore (36) adjacent the upper end (32) of the tubing head (22), while the lower end (78) of the supporting member (72) extends within the internal bore (36) towards the lower end (34) of the tubing head (22). The shape or configuration of the external surface (68) is compatible with the shape or configuration of the internal surface (62) such that the external surface (68) may be seated upon and suspended by the internal surface (62). Thus, in the preferred embodiment, in which the internal surface (62) is comprised of a shoulder, the external surface (68) is similar comprised of a compatible shoulder.

Further, the upper end (76) of the supporting member (72) defines a holddown screw engagement surface (84) which is compatible with the nose (50) of the holddown screw (48). Thus, upon adjustment of the holddown screw (48), the nose (50) may be moved into and out of engagement with the engagement surface (84) as desired for operation or servicing of the wellhead.

Finally, preferably, the adjacent surfaces of the internal bore (36) of the tubing head (22) and the outside surface (82) of the supporting member (72) are sealed by a sealing assembly. Any suitable sealing assembly may be used. However, in the preferred embodiment, the sealing assembly is comprised of the outside surface (82) of the supporting member (72) defining at least one annular groove, and preferably two, about the circumference or perimeter of the supporting member (72), for receiving an O-ring (86), polypak seal or other suitable seal.

Preferably, the supported member (74) is tubular such that a bore (88) of the supported member (74) permits the passage of the rod string and wellbore fluids therethrough. Further, he supported member (74) includes an upper end (90), a lower end (92) and an outside surface (94). The outside surface (94) of the supported member (74) preferably sealingly engages the inside surface (80) of the supporting member (72). The adjacent surfaces are sealingly engaged by a sealing assembly. Any suitable sealing assembly may be used. However, in the preferred embodiment, the sealing assembly is comprised of either or both of the inside surface (80) of the supporting member (72) and the outside surface (94) of the supported member (74) defining at least one annular groove, and preferably two or more, about the circumference or perimeter of such surfaces (80, 94), for receiving an O-ring (86), polypak seal or other suitable seal.

The upper end (90) of the supported member (74) is preferably positioned adjacent the upper end (76) of the supporting member (72). The bore (88) of the supported member (74) is preferably threaded for connection to a tool during the servicing of the well in order to facilitate the removal of the tubing hanger (24). The lower end (92) of the supported member (74) extends through the lower end (78) of the supporting member (72). As shown in FIGS. 3 and 8, the lower end (92) may or may not extend through the lower end (34) of the tubing head (22). Further, the outside surface (94) of the supported member (74) adjacent the lower end (92) is threaded such that the tubing string may be connected thereto by a tubing connector or like mechanism.

As indicated, the supported member (74) is rotatably supported by the supporting member (72) such that the longitudinal movement of the supported member (74) relative to the supporting member (72) in a direction towards the lower end (34) of the tubing head (22) is inhibited. Any means, mechanism, device or structure capable of supporting the supported member (74) in the required manner which is compatible with the function of the tubing hanger (24), may be used. However, preferably, the supported member (74) is rotatably supported within the supporting member (72) by at least one bearing (96) located between the supported member (74) and the supporting member (72) such that the bearing (96) is seated on the supporting member (72) and the supported member (74) is rotatably supported upon the bearing (96). Any bearing (96) suitable for, and compatible with, this intended purpose or function may be used. For instance, the bearing (96) may be comprised of a thrust bearing, a radial bearing, a tapered roller bearing or a combination thereof.

In the preferred embodiment, the inside surface (80) of the supporting member (72) includes a shoulder (98) which extends inwardly towards the supported member (74). The bearing (96) is seated on the shoulder (98). A compatible shoulder (100) on the outside surface (94) of the supported member (74) is then seated on the bearing (96) such that the supported member (74) is rotatably supported upon the supporting member (72). In this manner, the downward longitudinal movement of the supported member (74) relative to the supporting member (72) is inhibited. In the preferred embodiment, the bearing (96) is comprised of a thrust bearing in combination with a bushing sleeve (102) which acts as a radial bearing. The bushing sleeve (102) is also located between the supported member (74) and the supporting member (72), preferably above the thrust bearing.

Further, the supported member (74) is associated with the driven gear (26) such that rotation of the driven gear (26) causes the supported member (74) to rotate within the supporting member (72). Any structure, device, mechanism or means for associating the supported member (74) and the driven gear (26) in the described manner may be used. However, in the preferred embodiment, the driven gear (26) is fixedly mounted or connected about the outside surface (94) of the supported member (74) such that the driven gear (26) extends from the supported member (74) towards the gear housing (64) defined by the tubing head (22) for engagement with the drive gear (28). Thus, the driven gear (26) is preferably located along the supported member (74) at a position such that the driven gear (26) is adjacent to the drive gear (28) when the tubing hanger (24) is located within the internal bore (36) of the tubing head (22).

Figure 5:
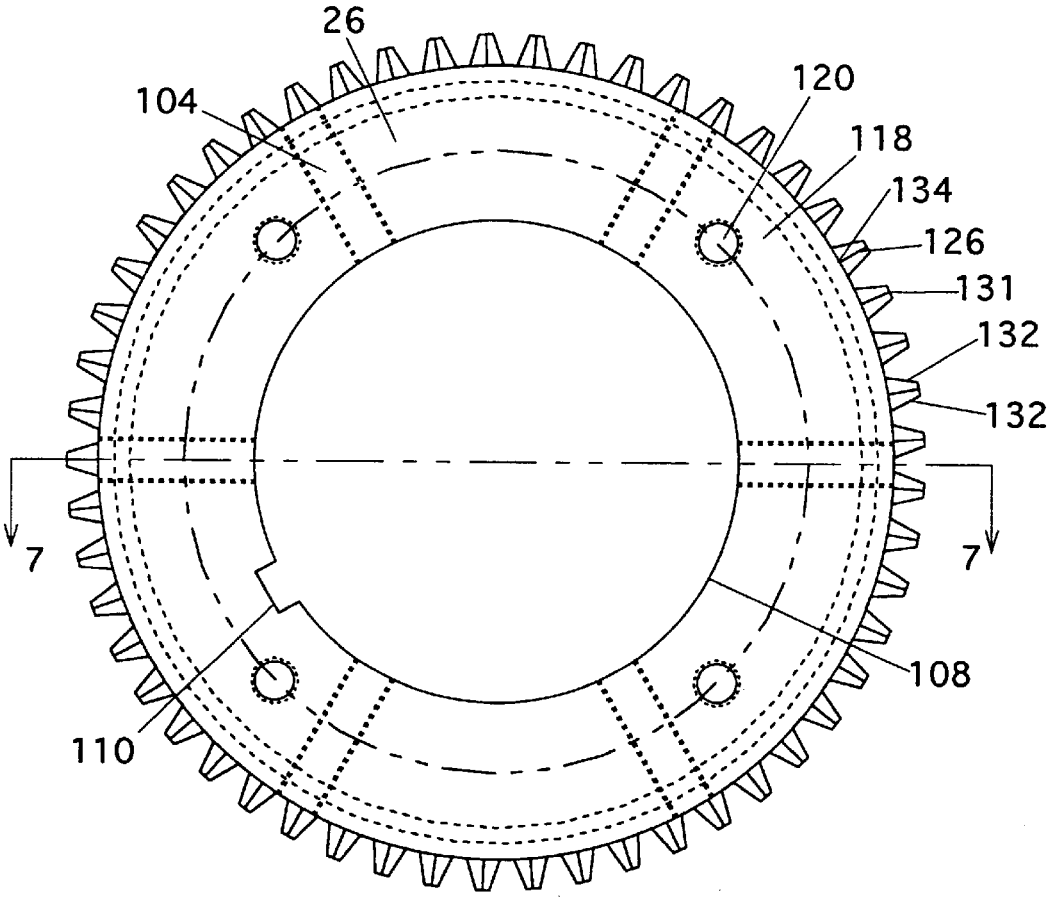
FIG. 5 is a bottom view of the worm gear shown in FIG. 4, shown in isolation.

In the preferred embodiment, the driven gear (26) is located about the supported member (74) such that an upper surface (103) of the driven gear (26) is adjacent the lower end (78) of the supporting member (72). The driven gear (26) may be mounted or otherwise fastened to the supported member (74) by any suitable means, structure, device or mechanism for mounting or fastening the driven gear (26) thereto. However, in the preferred embodiment, as shown in FIGS. 3 and 5–7, the driven gear (26) defines a plurality of threaded apertures (104) for the passage of a set screw (106) or similar fastener therethrough. Non-threaded apertures (105), compatible with the apertures (104) in the driven gear (26), are defined by the outside surface (94) of the supported member (74) for receiving an end of the set screws (106) therein. As well, an inside surface (108) of the driven gear (26) defines a keyway (110), as shown in FIGS. 3–5, which is compatible with a keyway (112) defined by the adjacent outside surface (94) of the supported member (74). Alignment of the keyways (110, 112) and the set screw apertures (104, 105), and the insertion of a key (114) and the set screws (106) respectively therein, facilitates in the proper or correct positioning of the driven gear (26) on the supported member (74).

In addition, the tubing hanger (24) further preferably comprises means for inhibiting the longitudinal movement of the supported member (74) relative to the supporting member (72) in a direction toward the upper end (32) of the tubing head (22). Any means, mechanism, structure or device capable of performing this function may be used, For instance, the inhibiting means may be comprised of a retaining ring or similar structure for securing the supported member (74) to the supporting member (72). However, in the preferred embodiment, the inhibiting means is comprised of the abutment of the driven gear (26) and the supporting member (72). More particularly, the uppermost surface of the driven gear (26) abuts the lower end (78) of the supporting member (72).

Finally, in the preferred embodiment, the tubing hanger (24) is further comprised of a bronze sealing retainer (116) which also provides a side load bearing surface. Referring to FIGS. 3 and 5–7, the sealing retainer (116) is mounted to a lower surface (118) of the driven gear (26). More particularly, the driven gear defines a plurality of threaded apertures (120) which extend from the lower surface (118) of the driven gear (26) towards the upper surface (103). The sealing retainer (116) defines a plurality of threaded apertures compatible with the threaded apertures (120) of the driven gear (26). Thus, the sealing retainer (116) may be positioned adjacent the lower surface (118) of the driven gear (26) and connected thereto by the passage of a fastener (122) through the compatible apertures in the sealing retainer (116) and the driven gear (26). Any suitable fastener (122) may be used, however, the fastener (122) is preferably a screw.

Preferably, the surface of the sealing retainer (116) adjacent the lower surface (118) of the driven gear (26) includes a sealing assembly. Any suitable sealing assembly may be used. However, in the preferred embodiment, the sealing assembly is comprised of the uppermost surface of the sealing retainer (116), adjacent the lower surface (118) of the driven gear (26), defining at least one annular groove about each of the inner and outer circumferences or perimeters of such surface for receiving an O-ring (86), polypak seal or other suitable seal. Alternately, the sealing retainer (116) may be an integral part of the driven gear (26), which defines the annular grooves for the seals.

In the preferred embodiment shown in FIG. 3, the tubing head (22) also further defines at least one annular vent (124). The annular vent (124) permits the venting or production of any fluids from the wellbore through the tubing head (22). Alternately, the annular vent (124) permits fluids to be directed into the wellbore through the tubing head (22). Preferably, each annular vent (124) extends from the outer wall (38) of the tubing head (22) to the internal bore (36). Further, the vents (124) are preferably located such that the vent (124) communicates with the internal bore (36) at a location such that when the tubing hanger (24) is located in the tubing head (22), the annular vent (124) is positioned between the sealing retainer (116) and the lower end (34) of the tubing head (22). However, the vent (124) must not be located such that it interferes with the mounting of the tubing head (22) on the casing string.

As stated, the drive system of the apparatus (20) is comprised of the drive gear (28) and the driven gear (26).

The drive gear (28) is of a type and configuration which is able to be accommodated or contained within the gear housing (64) and which is compatible with the driven gear (26) such that the drive gear (28) may releasably engage the driven gear (26) when the tubing hanger (24) is located within the internal bore (36). Further, the drive gear (28) is of a type and configuration such that it does not protrude into the internal bore (36) within the minimum diameter (66) of the internal bore (36). The driven gear (26) is also of a type and configuration which is able to be accommodated or contained within the internal bore (36) of the tubing head (22) and which is compatible with the driven gear (26) such that the driven gear (26) may releasably engage the drive gear (28) when the tubing hanger (24) is located within the internal bore (36). The driven gear (26) is also of a type and configuration capable of being associated with the tubing hanger (24), and in particular the supported member (74) such that rotation of the driven gear (26) causes the supported member (74) to rotate within the supporting member (72).

The drive gear (28) and the driven gear (26) may be comprised of any gears capable of performing the functions or purposes set out above, and which permit the drive gear (28) and the driven gear (26) to engage each other between the minimum diameter (66) and the maximum diameter (70) of the internal bore (36). However, preferably, the drive gear (28) is comprised of a worm and the driven gear (26) is comprised of a worm gear. Any suitable worm (28) and worm gear (28) may be used. For instance, a cylindrical worm (28) may mesh with a enveloped worm gear (26) to form a single enveloping type of wormgear drive system. Alternately, the worm (28) and the worm gear (26) may both be enveloping to form a double enveloping type of wormgear drive system. However, in the preferred embodiment, the worm (28) and the worm gear (26) are both non-enveloping in order to facilitate the removal of the tubing hanger from the internal bore without first disengaging the worm (28) from the worm gear (26).

Further, where a worm (28) and worm gear (26) are used, the worm (28) and worm gear (26) facilitate the connection of a servicing tool to the tubing hanger (24), and thus the removal of the tubing hanger (24) from the internal bore (36) of the tubing head (22), during servicing of the well. In particular, as the drive system is not first disengaged in order to service the well, the engagement between the worm (28) and the worm gear (26) inhibit any undesirable rotation of the supported member (74) during the connection of the servicing tool to the upper end (90) of the supported member (74) within the threaded bore (88).

Referring to FIGS. 4–7, the worm gear (26) is tubular for mounting about the supported member (74), as described above, and is preferably circular on cross section. In the preferred embodiment, each tooth (126) on the worm gear (26), located about the circumference of the worm gear (26), extends from an upper end (128), adjacent the upper surface (103) of the worm gear (26) towards the lower surface (118) of the worm gear (26) to a lower end (130). In the preferred embodiment, referring to FIG. 6, when viewed from the top face (131) of the tooth, the opposing sides (132) of the tooth (126), adjacent the lower end (130), are preferably tapered inwardly towards the centre of the tooth (126) in order to facilitate the feeding of the worm gear (26) onto the worm (28). In addition, in the preferred embodiment, referring to FIG. 6, when 25 viewed from the side (132) of the tooth (126), the tooth (126) is sloped downwardly, adjacent the lower end (130) of the tooth (126), from the top face (131) to the bottom face (134) in order to facilitate the feeding of the tubing hanger (24) into the internal bore (36) of the tubing head (22). Otherwise, the teeth (126) are shaped or configured to be compatible with the worm (28) such that a desired degree of meshing, contact or engagement occurs therebetween.

In the preferred embodiment, the worm gear (26) for a 7¹⁄₁₆ inches diameter tubing head (22) has the following specifications: a diametral pitch of 8; a single left hand thread; a pitch diameter of 6.625 inches; 53 teeth (126); a lead of 0.3927 inches; a lead angle of 4 degrees 46'; a pressure angle of 14½ degrees; and a centre distance of 4.0625 inches. As well, the worm gear (26) is preferably comprised of manganese bronze C86300, which reduces the galling of the teeth (126) under heavy loads.

Referring to FIGS. 3 and 4, in the preferred embodiment, the worm (28) is comprised of a worm shaft (136), which is preferably circular on cross section, and worm teeth (137) located about the circumference of the worm shaft (136) for a portion of the length of the worm shaft (136). Further, the worm shaft (136) has a first end (138) and a second end (140). The worm (28), and in particular the worm shaft (136), is rotatably supported within the gear housing (64) such that the worm shaft (136) may rotate about its longitudinal axis and such that the worm teeth (137) are positioned to engage the worm gear teeth (126) so that rotation of the worm shaft (136) causes rotation of the worm gear (26). The worm teeth (137) are shaped or configured to be compatible with the worm gear teeth (126) such that a desired degree of meshing, contact or engagement occurs therebetween. In addition, as shown in FIG. 4, the crest of the worm teeth (137) may be reduced where necessary to avoid the protrusion of the worm teeth (137) into the minimum diameter (66) of the internal bore (36). Also, the crest of the worm teeth (137) are preferably tapered to facilitate the feeding of the worm gear (26) into the worm (28). In the preferred embodiment, the worm (28) is comprised of a hardened and polished alloy steel.

The worm (28), and more particularly the worm shaft (136) may be rotatably supported within the gear housing (64) by any means, mechanism, structure or device suitable for, and capable of, supporting the worm shaft (136) in the desired manner such that the worm (28) may perform its function or purpose as described herein. In the preferred embodiment, the gear housing (64) is comprised of a first end (142) and a second end (144). The first end (138) of the worm shaft (136) is positioned within the gear housing (64) adjacent the first end (142) of the gear housing (64). The second end (140) of the worm shaft (136) extends through and beyond the second end (144) of the gear housing (64). Although the ends (142, 144) of the gear housing (64) may be integral with the remainder of the gear housing (64) defined by the tubing head (22), in the preferred embodiment, the first and second ends (142, 144) are removable therefrom in order to facilitate the mounting and maintenance of the worm (28).

In particular, in the preferred embodiment, the first and second ends (142, 144) of the gear housing (64) are each comprised of a bearing retainer (146) threaded within, or otherwise fastened to, the gear housing (64). For instance, the bearing retainer (146) may be fastened to the gear housing (64) using a lock nut (147). Each bearing retainer (146) may define a grease passage (148) extending from an outer surface to an inner surface of the bearing retainer (146) such that grease may be inserted therethrough. Further, each grease passage (148) includes a grease fitting (150) for sealing the grease passage (148) adjacent the outer surface of the bearing retainer (146). Finally, the bearing retainer (146) at the second end (144) of the gear housing (64) defines an opening for passage of the second end (140) of the worm shaft (136) therethrough such that the second end (140) of the worm shaft (136) is outside of the gear housing (64). Where the second end (140) of the worm shaft (136) exits the bearing retainer (146), the opening in the bearing retainer (146) preferably defines at least one annular groove for receiving a rod wiper (151) or the like therein.

One or more bearings (152) are mounted adjacent the inner surfaces of each bearing retainer (146), which bearings (152) rotatably support the worm shaft (136) which extends therethrough. Any bearing (152) suitable for, and compatible with, this intended purpose or function may be used. For instance, the bearing (152) may be comprised of a thrust bearing, a radial bearing, a tapered roller bearing or a combination thereof. The bearings (152) are located between, and maintained in position by, the adjacent bearing retainer (146) and a shoulder (154) on the worm shaft (136). Preferably, a sealing assembly is associated with each shoulder (154) for sealing the bearings (152) such that fluids and grease are unable to pass between the bearings (152) and the portion of the gear housing (64) containing the worm teeth (137). Any suitable sealing assembly may be used. However, in the preferred embodiment, the sealing assembly is comprised of one or more O-rings (86), polypak seals or other suitable seals.

Finally, the worm (28) is further comprised of means for driving or operating the worm (28) such that the worm (28) drives the worm gear (26). Any means, mechanism, structure or device suitable for, and capable of, driving or operating the worm (28) in the described manner may be used. Preferably, the driving structure or mechanism is more particularly comprised of means for rotating the worm shaft (136). Any means, mechanism, structure or device suitable for, and capable of, rotating the worm shaft (136) about its longitudinal axis may be used. The rotating structure or mechanism may be operated manually or by any other drive motor or mechanism.

Preferably, the worm shaft (136) is rotated manually. A ratchet and pawl assembly (156), or a like mechanism, is operably mounted or connected to the second end (140) of the worm shaft (136). In the preferred embodiment, the ratchet and pawl assembly is comprised of a sprage clutch. Further, the ratchet and pawl assembly includes a drive handle (158) such that movement of the drive handle (158) causes rotation of the worm shaft (136).

The embodiments of the invention in which an exclusive property or privilege is claimed are defined as follows:

1. A tubing head for accommodating a tubing rotator therein, the tubing head being of the type having an upper end, a lower end for attachment to a wellhead and an internal bore extending between the upper and lower ends, wherein the tubing rotator comprises a drive gear and a swivel tubing hanger for rotatably suspending a tubing string contained within a wellbore, the tubing hanger comprising an external surface for engaging the internal bore of the tubing head such that the tubing hanger may be suspended thereby and a driven gear for engaging the drive gear, the improvement which comprises:

(a) the internal bore of the tubing head defining an internal surface for engaging the external surface of the tubing hanger such that the tubing hanger may be suspended by the tubing head and wherein the internal bore of the tubing head further defines a minimum diameter of the bore; and (b) the tubing head defining a gear housing for containing the drive gear therein, wherein the gear housing communicates with the internal bore such that the drive gear may releasably engage the driven gear of the tubing hanger when the tubing hanger is suspended by the tubing head and wherein the gear housing is configured such that when the drive gear is contained within the gear housing, the drive gear does not protrude into the internal bore within the minimum diameter;

wherein the internal surface, the gear housing, the drive gear and the driven gear are configured such that when the drive gear is contained within the gear housing, the tubing hanger is located in the internal bore and the driven gear is engaging the drive gear, the tubing hanger is capable of being removed from the internal bore by pulling it through the upper end of the tubing head without first disengaging the drive gear from the driven gear.

2. The tubing head as claimed in claim 1 wherein the internal surface of the tubing head defines a maximum diameter of the internal bore which is about equal to a maximum diameter of the tubing hanger and wherein the maximum diameter of the tubing hanger permits the tubing hanger to be removed from the internal bore by pulling it through a blowout preventer in order to service the well.

3. The tubing head as claimed in claim 2 wherein the drive gear and the driven gear engage each other between the minimum diameter and the maximum diameter.

4. The tubing head as claimed in claim 3 wherein the drive gear is comprised of a worm and the driven gear is comprised of a worm gear.

5. The tubing head as claimed in claim 4 wherein the worm and the worm gear are non-enveloping in order to facilitate the removal of the tubing hanger from the internal bore without first disengaging the worm from the worm gear.

6. The tubing head as claimed in claim 5 wherein the tubing head is further comprised of at least one adjustable holddown screw for engagement with the tubing hanger such that when the holddown screw is adjusted for engagement with the tubing hanger, longitudinal movement of the tubing hanger in a direction toward the upper end of the tubing head is inhibited.

7. The tubing head as claimed in claim 6 wherein the tubing head is comprised of at least two holddown screws located adjacent the upper end of the tubing head.

8. The tubing head as claimed in claim 6 wherein the tubing head is further comprised of means for mounting the tubing head on the wellhead.

9. The tubing head as claimed in claim 8 wherein the mounting means is comprised of a mounting portion of the internal bore of the tubing head adjacent the lower end.

10. The tubing head as claimed in claim 8 wherein the mounting means is comprised of a lower surface on the lower end of the tubing head.

11. The tubing head as claimed in claim 10 wherein the lower surface of the tubing head is comprised of a mounting flange.

12. The tubing head as claimed in claim 8 wherein the tubing head is further comprised of means for connecting the upper end of the tubing head to other wellhead equipment.

13. An apparatus for attachment to a wellhead for suspending and rotating a tubing string contained within a wellbore, the apparatus comprising:

(a) a tubing head having an upper end, a lower end for attachment to a wellhead and an internal bore extending between the upper and lower ends, wherein the internal bore of the tubing head defines an internal surface and a minimum diameter of the bore and wherein the tubing head further defines a gear housing which communicates with the internal bore;

(b) a swivel tubing hanger for locating within the internal bore and for connecting to the tubing string, the tubing hanger comprising a driven gear and an external surface for engaging the internal surface of the tubing head such that the tubing hanger may be suspended by the tubing head; and (c) a drive gear for containing within the gear housing and for releasably engaging the driven gear of the tubing hanger, wherein the gear housing is configured such that when the drive gear is contained within the gear housing, the drive gear does not protrude into the internal bore within the minimum diameter;

wherein the internal surface, the gear housing, the drive gear and the driven gear are configured such that when the drive gear is contained within the gear housing, the tubing hanger is located in the internal bore and the driven gear is engaging the drive gear, the tubing hanger is capable of being removed from the internal bore by pulling it through the upper end of the tubing head without first disengaging the drive gear from the driven gear.

14. The apparatus as claimed in claim 13 wherein the internal surface of the tubing head defines a maximum diameter of the internal bore which is about equal to a maximum diameter of the tubing hanger and wherein the maximum diameter of the tubing hanger permits the tubing hanger to be removed from the internal bore by pulling it through a blowout preventer in order to service the well.

15. The apparatus as claimed in claim 14 wherein the drive gear and the driven gear engage each other between the minimum diameter and the maximum diameter.

16. The apparatus as claimed in claim 15 wherein the drive gear is comprised of a worm and the driven gear is comprised of a worm gear.

17. The apparatus as claimed in claim 16 wherein the worm and the worm gear are non-enveloping in order to facilitate the removal of the tubing hanger from the internal bore without first disengaging the worm from the worm gear.

18. The apparatus as claimed in claim 17 wherein the worm gear is comprised of a plurality of worm gear teeth and wherein a lower end of each worm gear tooth is tapered inwardly towards a centre of the tooth in order to facilitate the feeding of the worm gear onto the worm.

19. The apparatus as claimed in claim 18 wherein the lower end of each worm gear tooth is sloped downwardly from a top face to a bottom face of the tooth in order to facilitate the feeding of the tubing hanger into the internal bore of the tubing head.

20. The apparatus as claimed in claim 19 wherein the worm is comprised of a plurality of worm teeth and wherein a crest of each worm tooth is tapered to facilitate the feeding of the worm gear onto the worm.

21. The apparatus as claimed in claim 17 wherein the tubing head is further comprised of at least one adjustable holddown screw for engagement with the tubing hanger such that when the holddown screw is adjusted for engagement with the tubing hanger, longitudinal movement of the tubing hanger in a direction toward the upper end of the tubing head is inhibited.

22. The apparatus as claimed in claim 21 wherein the tubing head is comprised of at least two holddownscrews located adjacent the upper end of the tubing head.

23. The apparatus as claimed in claim 21 wherein the tubing hanger is further comprised of:

(a) a supporting member comprising the external surface of the tubing hanger; and (b) a supported member rotatably supported within the supporting member such that the longitudinal movement of the supported member relative to the supporting member in a direction toward the lower end of the tubing head is inhibited, the supported member having an upper end and a lower end for connecting to the tubing string and wherein the supported member is associated with the driven gear such that rotation of the driven gear causes the supported member to rotate within the supporting member.

24. The apparatus as claimed in claim 23 wherein the driven gear is fixedly mounted about the supported member such that the driven gear extends from the supported member towards the gear housing of the tubing head for engagement with the drive gear.

25. The apparatus as claimed in claim 24 wherein the tubing hanger further comprises means for inhibiting the longitudinal movement of the supported member relative to the supporting member in a direction toward the upper end of the tubing head.

26. The apparatus as claimed in claim 25 wherein the inhibiting means is comprised of an abutment of the driven gear and the supporting member.

27. The apparatus as claimed in claim 24 wherein the supported member is rotatably supported within the supporting member by at least one bearing located between the supported member and the supporting member such that the bearing is seated on the supporting member and the supported member is rotatably supported upon the bearing.

28. The apparatus as claimed in claim 27 wherein the bearing is comprised of a thrust bearing in combination with a bushing sleeve.

29. The apparatus as claimed in claim 21 wherein the tubing head is further comprised of means for mounting the tubing head on the wellhead.

30. The apparatus as claimed in claim 29 wherein the mounting means is comprised of a mounting portion of the internal bore of the tubing head adjacent the lower end.

31. The apparatus as claimed in claim 29 wherein the mounting means is comprised of a lower surface on the lower end of the tubing head.

32. The apparatus as claimed in claim 31 wherein the lower surface of the tubing head is comprised of a mounting flange.

33. The apparatus as claimed in claim 29 wherein the tubing head is further comprised of means for connecting the upper end of the tubing head to other wellhead equipment.

* * * * *